US011087676B2

(12) United States Patent
Gao et al.

(10) Patent No.: US 11,087,676 B2
(45) Date of Patent: Aug. 10, 2021

(54) DEVICE AND METHOD FOR OBTAINING BRIGHTNESS OF DISPLAY PANEL

(71) Applicant: Wuhan Tianma Micro-Electronics Co., Ltd., Wuhan (CN)

(72) Inventors: Xiangyu Gao, Wuhan (CN); Guang Wang, Wuhan (CN); Ruiyuan Zhou, Wuhan (CN); Jingxiong Zhou, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 16/849,764

(22) Filed: Apr. 15, 2020

(65) Prior Publication Data

US 2021/0210010 A1 Jul. 8, 2021

(30) Foreign Application Priority Data

Jan. 3, 2020 (CN) ..... 202010005835.1

(51) Int. Cl.
*G09G 3/3225* (2016.01)

(52) U.S. Cl.
CPC ... *G09G 3/3225* (2013.01); *G09G 2320/0626* (2013.01); *G09G 2360/145* (2013.01)

(58) Field of Classification Search
USPC ..... 345/207
See application file for complete search history.

(56) References Cited

U.S. PATENT DOCUMENTS

2008/0143753 A1* 6/2008 Ou-Yang ..... G09G 3/006 345/690
2013/0321740 A1* 12/2013 An ..... H05K 5/02 349/58
2014/0118319 A1* 5/2014 Jeon ..... G06F 1/00 345/207
2014/0362126 A1* 12/2014 Jeong ..... G09G 3/3233 345/690
2015/0379922 A1* 12/2015 Zhang ..... G09G 3/3208 345/690
2016/0196778 A1* 7/2016 Cha ..... G09G 3/20 345/694
2016/0210901 A1* 7/2016 Cha ..... G09G 3/3225
(Continued)

FOREIGN PATENT DOCUMENTS

CN 109752381 A 5/2019

*Primary Examiner* — Chineyere D Wills-Burns
(74) *Attorney, Agent, or Firm* — Anova Law Group, PLLC

(57) ABSTRACT

A device and a method for obtaining brightness of a display panel are provided. The display panel includes a flat area and a curved area and the curved areas including at least one first curved area. The device includes a brightness acquisition component; an optical path adjustment component; and a control component. Principle light exited from the flat area is incident on a first area of a viewfinder plane of the brightness acquisition component; the optical path adjustment component is disposed on an optical path of principle light exited from the first curved area, and configured to adjust the principle light to be incident on a second area of the viewfinder plane; the first area does not overlap with and the second area; and the control component is configured to process an image captured by the brightness acquisition component to obtain the brightness of the display panel.

19 Claims, 13 Drawing Sheets

(56) References Cited

U.S. PATENT DOCUMENTS

| | | | | |
|---|---|---|---|---|
| 2017/0206859 | A1* | 7/2017 | Jun | G09G 5/10 |
| 2020/0066219 | A1* | 2/2020 | Hsu | G09G 3/006 |
| 2020/0294469 | A1* | 9/2020 | Kim | G09G 5/00 |

* cited by examiner

DEVICE AND METHOD FOR OBTAINING BRIGHTNESS OF DISPLAY PANEL

CROSS-REFERENCE TO RELATED APPLICATIONS

This application claims priority of Chinese Patent Application No. 202010005835.1, filed on Jan. 3, 2020, the entire contents of which are hereby incorporated by reference.

FIELD OF THE DISCLOSURE

The present disclosure generally relates to the field of display technology and, more particularly, relates to a device and a method for obtaining brightness of a display panel.

BACKGROUND

Organic light-emitting display panels have the advantages of self-illumination, no backlight, low power, high brightness, and small thickness. However, organic light-emitting display panels also have poor brightness uniformity and afterimage problems, causing undesirable display effects. Compensation technologies are often used to solve such problems.

Optical compensation technology is a commonly used compensation technology. In particular, a corresponding compensation is performed after obtaining the pixel brightness information of the display panel through an external device. The external device is usually a CCD camera. The CCD camera captures the light exited from each area of the display panel to form an image containing the pixel brightness information. For a flexible display panel, the energy of the light exited from an area with a large bending angle is substantially small along the direction perpendicular to the viewfinder plane of the CCD camera. Thus, the CCD camera is unable to effectively obtain the pixel brightness information of the area with the large bending angle. Accordingly, a corresponding compensation based on the pixel brightness information of the area cannot be subsequently performed, and the compensation effect of the display panel is adversely affected.

Therefore, there is a need to provide a device and a method to accurately obtain the brightness of a display panel. The disclosed device and method are directed to solve one or more problems set forth above and other problems in the art.

BRIEF SUMMARY OF THE DISCLOSURE

One aspect of the present disclosure provides a device for obtaining brightness of a display panel. The display panel includes a flat area and a curved area; and the curved area includes at least one first curved area. The device may include a brightness acquisition component; an optical path adjustment component; and a control component. The brightness acquisition component is configured to face straight to the flat area of the display panel; principle light exited from the flat area is incident on a first area of a viewfinder plane of the brightness acquisition component; the optical path adjustment component is disposed on an optical path of principle light exited from the first curved area, and configured to adjust the principle light exited from the first curved area to be incident on a second area of the viewfinder plane of the brightness acquisition component; the first area does not overlap with and the second area; and the control component is connected to the brightness acquisition component and configured to process an image captured by the brightness acquisition component to obtain the brightness of the display panel.

Another aspect of the present disclosure provides a method for obtaining brightness of a display panel. The method includes providing a display panel including a flat area, and a curved area including at least one first curved area; and providing a device for obtaining brightness of the display panel. The device includes a brightness acquisition component, an optical path adjustment component, and a control component. The brightness acquisition component is configured to face straight to the flat area of the display panel; principle light exited from the flat area is incident on a first area of a viewfinder plane of the brightness acquisition component; the optical path adjustment component is disposed on an optical path of principle light exited from the first curved area, and configured to adjust the principle light exited from the first curved area to be incident on a second area of the viewfinder plane of the brightness acquisition component; the first area does not overlap with and the second area; and the control component is connected to the brightness acquisition component and configured to process an image captured by the brightness acquisition component to obtain the brightness of the display panel. The method also includes lighting up the display panel; capturing an image of a displayed image of the display panel using the brightness acquisition component; and processing the image using the control component to obtain the brightness of the display panel.

Other aspects of the present disclosure can be understood by those skilled in the art in light of the description, the claims, and the drawings of the present disclosure.

BRIEF DESCRIPTION OF THE DRAWINGS

The following drawings are incorporated in and constitute a part of the specification, illustrating embodiments of the present disclosure, and together with the detailed descriptions serve to explain the mechanism of the present disclosure.

DETAILED DESCRIPTION

Figure 1:
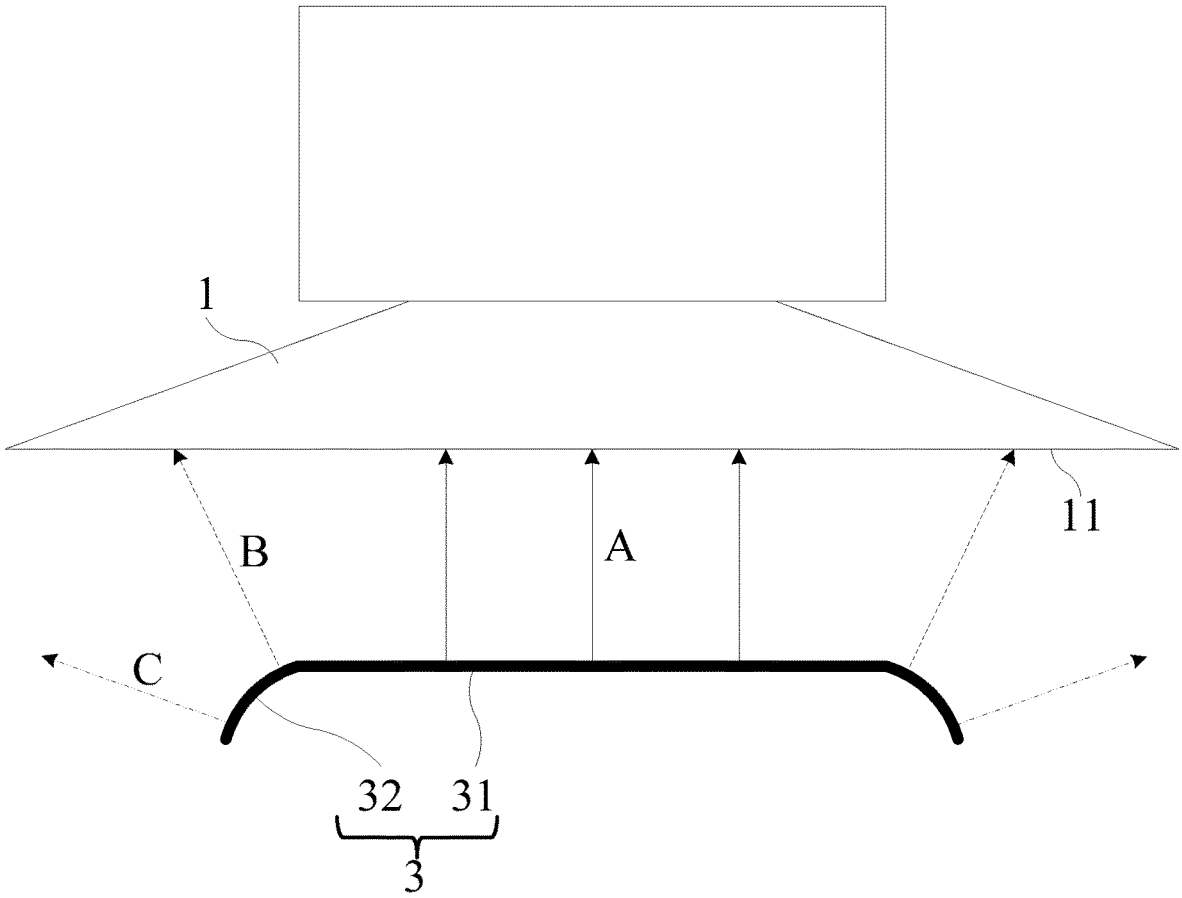
FIG. 1 illustrates brightness acquisition of a display panel.

To further describe the technical approach and effects adopted by the present disclosure to achieve the intended purposes of the present disclosure, specific implementations of a device and a method for obtaining brightness of a display panel according to the present disclosure are described below with reference to the accompanying drawings and preferred embodiments. The structure, characteristics and effects are described in detail below. Wherever possible, the same reference numbers will be used throughout the drawings to refer to the same or like parts.

The present disclosure provides a device for obtaining brightness of a display panel and a method for obtaining brightness of a display panel. The display panel may include a flat area and a curved area. The curved area may include at least one first curved area. The device for obtaining brightness of the display panel may include a brightness acquisition component, an optical path adjustment component, and a control component.

The brightness acquisition component may be configured to directly face to the flat area of the display panel, and the principle light exited from the flat area may be incident on a first area of the viewfinder plane of the brightness acquisition component.

The optical path adjustment component may be disposed on an optical path of the light exited from the first curved area, and may be configured to adjust the principle light exited from the first curved area to a second area of the viewfinder plane of the brightness acquisition component. The second area may not overlap with the first area.

The control component may be connected to the brightness acquisition component; and may be configured to process the image captured by the brightness acquisition component to obtain the brightness of the display panel.

According to the technical solution provided in the present disclosure, by disposing the optical path adjustment component on the optical path of the light exited from the first curved area of the display panel, the optical path adjustment component may be configured to adjust the principle light exited from the first curved area to be incident on the second area of the viewfinder plane of the brightness acquisition component. The second area may not overlap the first area of the viewfinder plane of the brightness acquisition component corresponding to the principle light exited from the flat area of the display panel such that the principle light exited from the flat area and the first curved area of the display panel may be incident on different areas of the viewfinder plane of the brightness acquisition component. The brightness acquisition component may obtain the brightness information of all pixels in the display panel, and the principle light exited from the flat area and the first curved area may not interfere with each other. Thus, the accuracy of the pixel brightness information obtained by the brightness acquisition component may be improved; and the compensation effect may be enhanced.

The above may be the core idea of the present disclosure. The technical solutions in the embodiments of the present disclosure will be clearly and completely described below with reference to the drawings in the embodiments of the present disclosure. Obviously, the described embodiments are only a part of the embodiments of the present disclosure; and not all embodiments. Based on the embodiments of the present disclosure, all other embodiments obtained by those of ordinary skill in the art without creative efforts shall fall within the protection scope of the present disclosure.

In the following description, specific details are set forth in order to fully understand the present disclosure, but the present disclosure can also be implemented by other embodiments different from those described herein, and those skilled in the art may make similar promotion without violating the meaning of the present disclosure. Thus, the present disclosure is not limited by the specific embodiments disclosed below.

Secondly, the present disclosure is described in detail with reference to schematic diagrams. In the detailed description of the embodiments of the present disclosure, for the convenience of explanation, the schematic diagrams showing the structure of the device are not partially enlarged according to general proportions, and the schematic diagrams are merely examples, which should not limit the scope of the present disclosure. In addition, the actual production should include three-dimensional sizes of length, width and height.

FIG. 1 illustrates a device for obtaining brightness of a display panel. As shown in FIG. 1, the display panel 3 includes a flat area 31 and two curved areas 32. The flat area 31 is disposed to face to a brightness acquisition component 1. The curved areas 32 are located outside the flat area 31. Each light-emitting point in the display panel 3 simultaneously emits a plurality of rays of light transmitted along different directions, but the energy of the light is mainly concentrated on the principle light transmitted along the direction perpendicular to the tangent of the light-emitting point. FIG. 1 illustrates the first principal light A exited from the light-emitting points in the flat area 31, the second principal light B exited from the light-emitting points in the curved area 32 with a small curvature, and the third principal light C exited from the light-emitting points in the curved area 32 with a large curvature. The image acquisition component 1 is used to collect the light incident on the viewfinder plane 11 to form an image containing pixel brightness information. As shown in FIG. 1, the image acquisition component 1 is capable of acquiring the first principal light A exited from the light-emitting point in the flat area 31 and the second principal light B exited from the light-emitting point in the curved area 32 with the small curvature. However, the third principal light C exited from the light-emitting point in the curved area 32 with the large curvature cannot be acquired. The auxiliary light exited from the light-emitting point of the third principal light C and incident perpendicularly on the viewfinder plane 11 is used to form a brightness image of a corresponding area.

On the one hand, among the light exited from a same light-emitting point, the light farther away from the principle light have less energy. Therefore, in the curved area 32 with the large curvature, as the degree of curvature increases, the portion of the light exited from the light-emitting point incident on the viewfinder plane 11 is reduced. As a result, the portion of the image formed by the brightness acquisition component 1 corresponding to the curved area 32 having the large curvature is almost black. On the other hand, as the curvature of the curved area 32 increases, the distance between the vertical projections of adjacent pixels on the plane to which the flat area 31 belongs in the curved area 32 with the large curvature decreases. If the light exited from the pixel and reaching the viewfinder plane 11 form pixel areas, as the curvature of the curved area 32 increases, the distance between the pixel areas corresponding to adjacent pixels gradually decreases, and the adjacent pixel areas gradually overlap. Thus, the two pixel areas cannot be accurately distinguished. Accordingly, the brightness information of the corresponding pixels cannot be accurately extracted in the brightness image.

Figure 2:
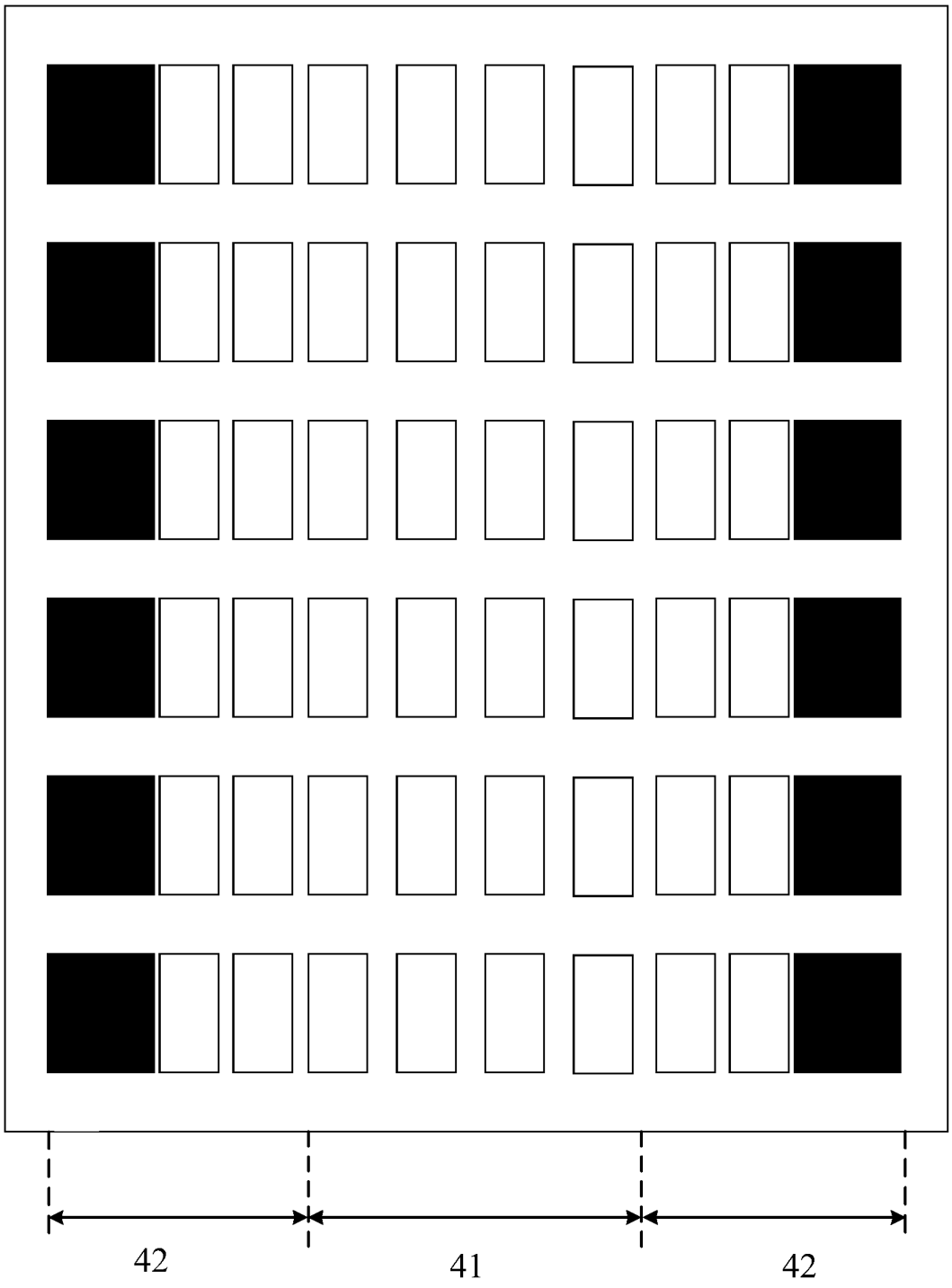
FIG. 2 illustrates a brightness image taken by the brightness acquisition component in FIG. 1.

FIG. 2 illustrates an exemplary brightness image of the display panel taken by the brightness acquisition component in FIG. 1. As shown in FIG. 2, the brightness image includes a first area 41 and two second areas 42. The first area 41 corresponds to the flat area of the display panel, and the second areas 42 correspond to the curved areas of the display panel. Along the direction that the degree of curvature of the curved area increases, the corresponding brightness information in the brightness image is reduced, and the edge area has no brightness information and it is pure black. Thus, it is impossible to extract the pixel brightness information of the corresponding curved area from the brightness image; and the compensation effect may be adversely affected.

The present disclosure provides a device for obtaining brightness of a display panel and a method for obtaining brightness of a display panel. The device and the method for obtaining brightness of the display panel may enable all the principle light exited from the light-emitting points in the flat area and the curved area of the display panel to be incident on the viewfinder plane of a brightness acquisition component. The brightness image formed by the brightness acquisition component may accurately contain the brightness information of all pixels of the display panel, which may facilitate the effective compensation of pixel brightness.

Figure 3:
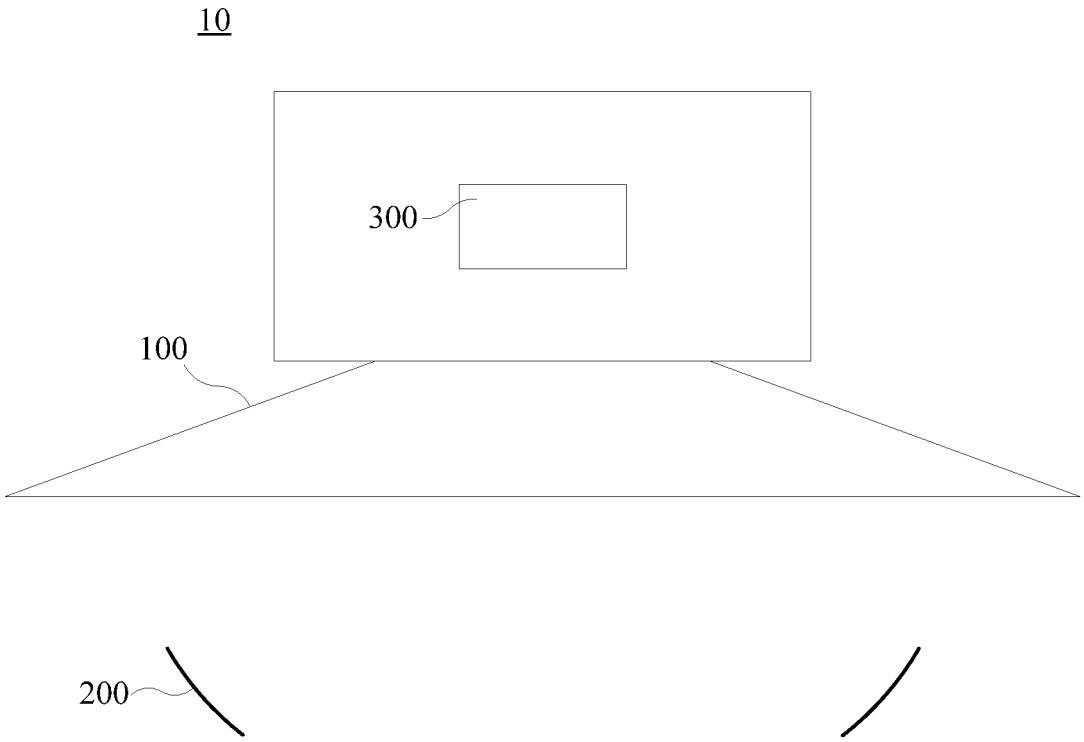
FIG. 3 illustrates an exemplary device for obtaining brightness of a display panel consistent with various disclosed embodiments of the present disclosure.

FIG. 3 illustrates an exemplary device for obtaining brightness of a display panel consistent with various disclosed embodiments of the present disclosure. As shown in FIG. 3, the device 10 for obtaining brightness of the display panel may include a brightness acquisition component 100, an optical path adjustment component 200, and a control component 300.

Figure 4:
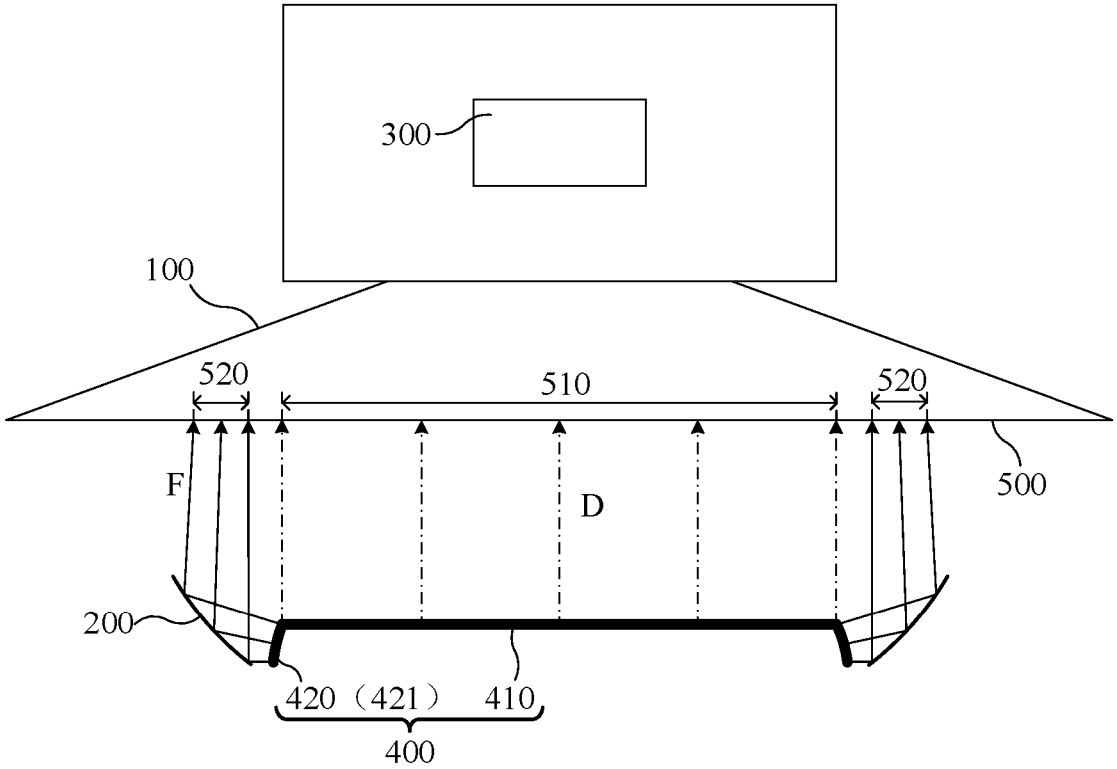
FIG. 4 illustrates an exemplary device for obtaining brightness of a display panel working normally consistent with various disclosed embodiments of the present disclosure.

FIG. 4 illustrates an exemplary device for obtaining brightness of a display panel working normally consistent with various disclosed embodiments of the present disclosure. As shown in FIG. 4, the display panel 400 may include a flat area 410 and a curved area 420. The curved area 420 may include at least one first curved area 421. The brightness acquisition component 100 may be configured to face to the flat area 410 of the display panel 400, and the principle light D exited from the flat area 410 may be incident on a first area 510 of a viewfinder plane 500 of the brightness acquisition component 100. The optical path adjustment component 200 may be disposed on the optical path of the light exited from the first curved area 421, and may be configured to adjust the principle light F exited from the first curved area 421 to be incident on the second area 520 of the viewfinder plane 500 of the brightness acquisition component 100. The second area 520 may not overlap with the first area 510, and the control component 300 may be connected to the brightness acquisition component 100, and may be configured to process the image captured by the brightness acquisition component 100 to obtain the brightness of the display panel 10.

The energy of the light exited from the display panel 10 may be mainly concentrated on the principal light transmitted along a direction perpendicular to the tangent of the light-emitting point, and the energy of the light transmitted along other directions may be smaller, and the energy that is farther away from the principal light may be even smaller. FIG. 4 only illustrates a portion of the principal light exited from the flat area 410 and the curved area 420.

The first curved area 421 may be an area with a large curvature in the curved area 420. In one embodiment, as shown in FIG. 4, the curved area 420 may include only the first curved area 421. In some embodiments, the curved area 420 may further include other curved area outside the first curved area 421.

Figure 5:
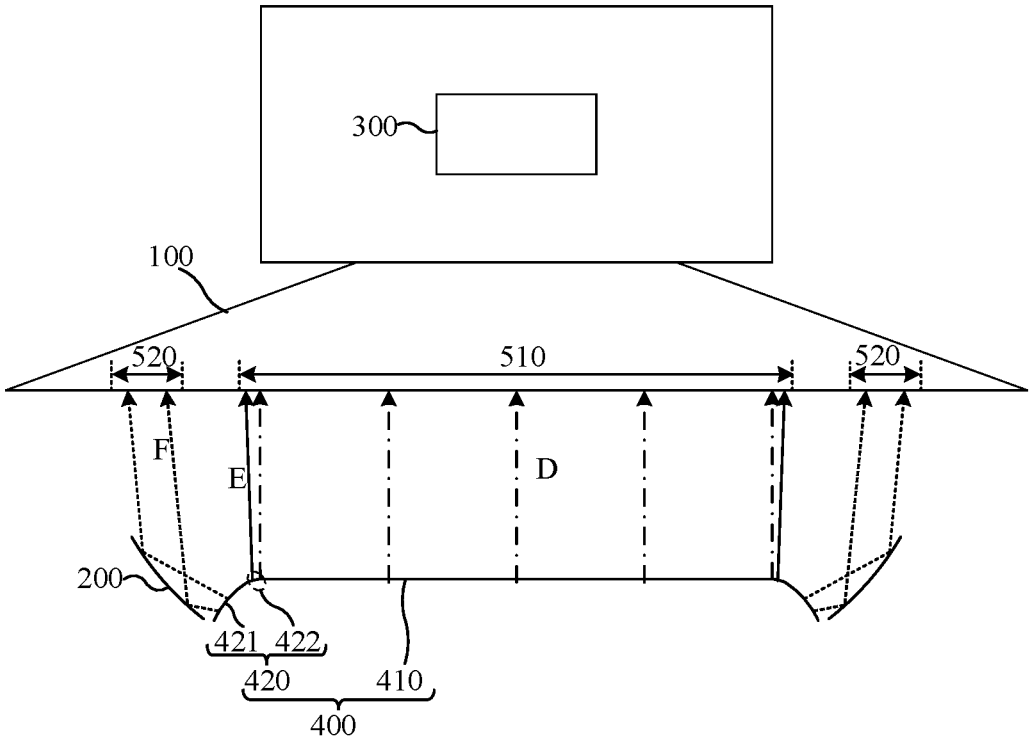
FIG. 5 illustrates another exemplary device for obtaining brightness of a display panel working normally consistent with various disclosed embodiments of the present disclosure.

FIG. 5 illustrates another exemplary device for obtaining brightness of a display panel working normally consistent with various disclosed embodiments of the present disclosure. As shown in FIG. 5, based on the structure of the display panel 400 illustrated in FIG. 4, the curved area 420 may further include a second curved area 422, and the second curved area 422 may be disposed between the first curved area 421 and the flat area 410. The curvature of the second curved area 422 may be relatively small, and the principle light E exited from the second curved area 422 may be incident on the viewfinder plane 500 of the brightness acquisition component 100. For illustrative purposes, as shown in FIG. 5, the principle light E may be incident on the first area 510 of the viewfinder plane 500.

Figure 6:
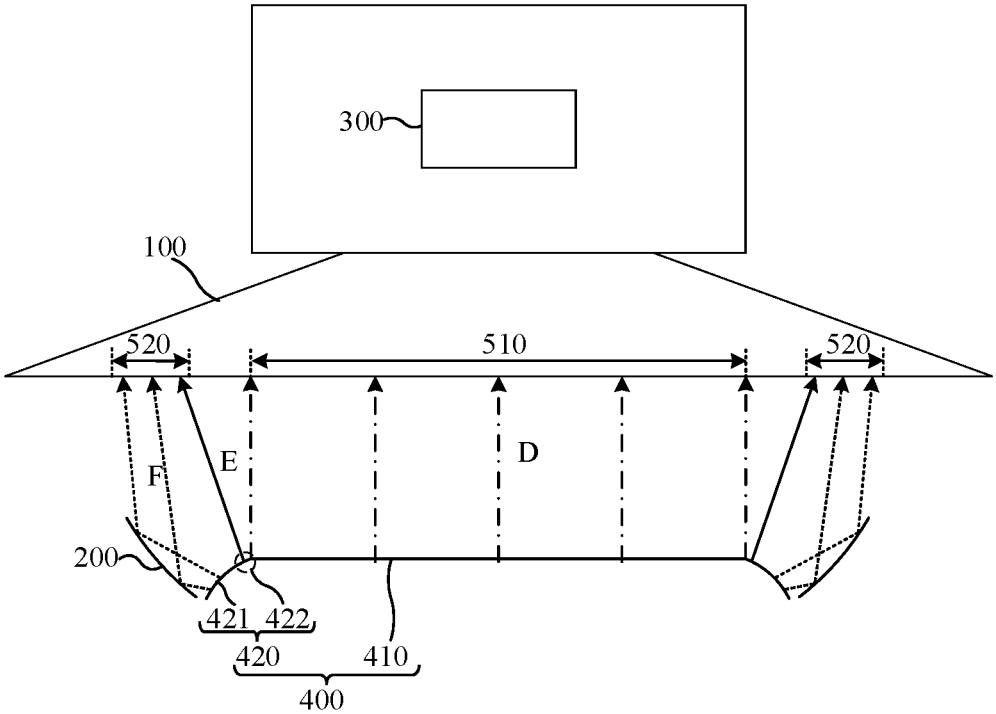
FIG. 6 illustrates another exemplary device for obtaining brightness of a display panel working normally consistent with various disclosed embodiments of the present disclosure.

In some embodiments, as shown in FIG. 6, the principle light E may be incident on the second area 520 of the viewfinder plane 500, and may not overlap with the principle light F incident on the first area 510. Accordingly, the pixels corresponding to the principal light F and the principal light E may be accurately distinguished in the correspondingly obtained brightness image. Under the configurations illustrated in FIG. 5 and FIG. 6 described above, the corresponding principle light E may not need to be introduced into the viewfinder plane 500 of the brightness acquisition component 100, the design difficulty of the optical path adjustment component 200 may be simplified based on the condition that the brightness information of the entire display panel may be obtained by the brightness acquisition component 100.

Figure 7:
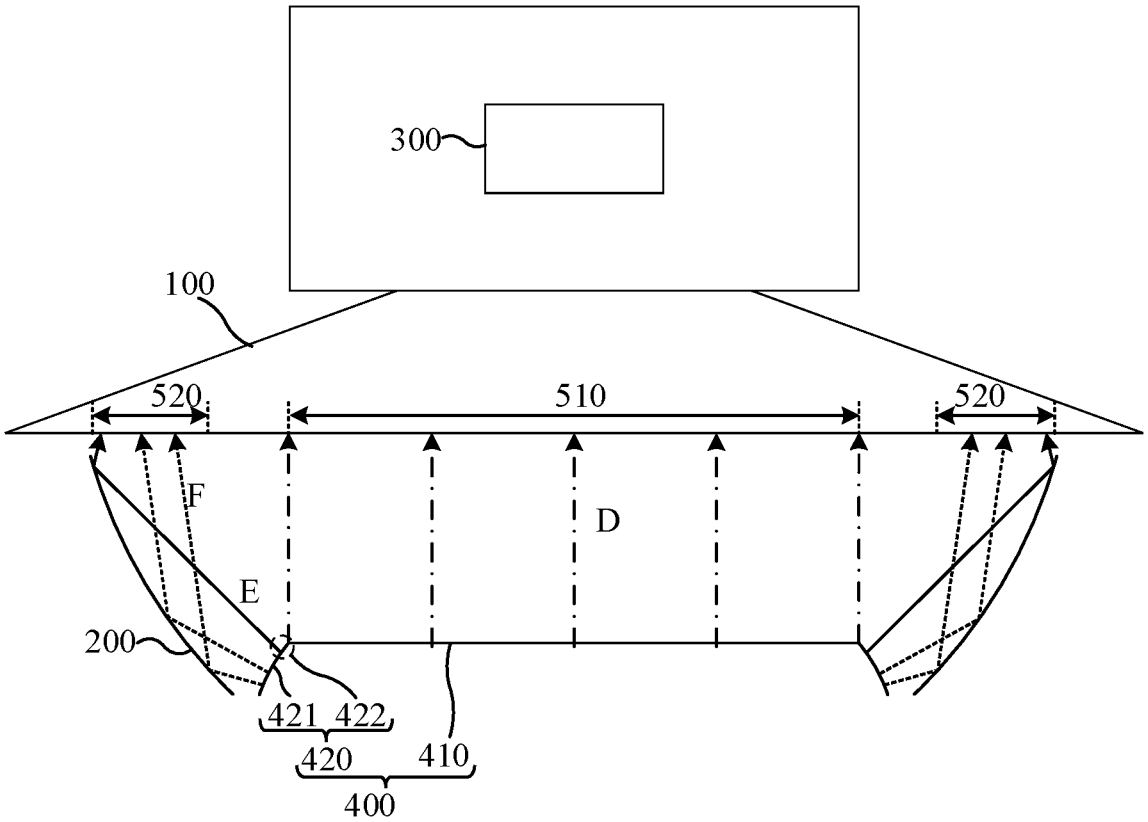
FIG. 7 illustrates another exemplary device for obtaining brightness of a display panel working normally consistent with various disclosed embodiments of the present disclosure.

According to different curvatures of the second curved area 422, the principle light E exited from the second curved area 422 may have different incident areas in the viewfinder plane 500. In particular, as shown in FIG. 5, when the curvature of the second curved area 422 is small, the principal light E may be incident on the first area 510, and the principal light E and the principal light D may not interfere with each other. Further, as shown in FIG. 6, the curvature of the second curved area 422 may be slightly increased, the principle light E may be incident on the second area 520, and the principle light E and the principle light F may not interfere with each other. When the curvature of the second curved area 422 continues to be increased, the incident area of the principle light E on the viewfinder plane 500 may be as follows. When the principle light E is transmitted along its natural transmission direction to the portion overlapping with the principle light F in the second area 520, and the principle light E and the principle light F may interfere with each other. Thus, the pixel brightness in the first curved area 421 and the second curved area 422 may not be effectively obtained. At this time, as shown in FIG. 7, the optical path adjustment component 200 may be configured to adjust the optical path of the principle light F exited from the first curved area 421 and the principle light E exited from the second area surface 422 to prevent interfering with each other.

The optical path adjustment component 200 may be configured to adjust the optical path of the principle light exited from at least a portion of the curved area 420 such that the principle light whose optical path is adjusted may be incident on the second area 520. Accordingly, the brightness acquisition component 100 may acquire the pixel brightness information in the corresponding curved area 420. In one embodiment, the structure of the optical path adjustment component 200 may be adjusted to achieve a non-overlapping of the first area 510 and the second area 520, the interference between the light exited from the flat area 410 and the light exited from the curved area 420 may be avoided.

The specific structure of the optical path adjustment component 200 is not limited by the present disclosure. Any structure capable of realizing the optical path adjustment function is within the protection scope of the present disclosure.

In the technical solution provided in the present disclosure, the optical path adjustment component may be disposed on the optical path of light exited from a first curved area of the display panel, and the optical path adjustment component may be used to adjust the principle light exited from the first curved area to be incident on the second area of the viewfinder plane of the brightness acquisition component. The second area may not overlap the first area of the viewfinder plane of the brightness acquisition component corresponding to the principle light exited from the flat area of the display panel such that the principle light exited from the flat area and the first curved area of the display panel may be incident on different areas of the viewfinder plane of the brightness acquisition component. Accordingly, the brightness acquisition component may be able to obtain the brightness information of all pixels in the display panel. Further, the principle light exited from the flat area and the first curved area may not interfere with each other. Thus, the accuracy of the pixel brightness information obtained by the brightness acquisition component may be improved; and the improvement of the compensation effect may be facilitated.

Figure 8:
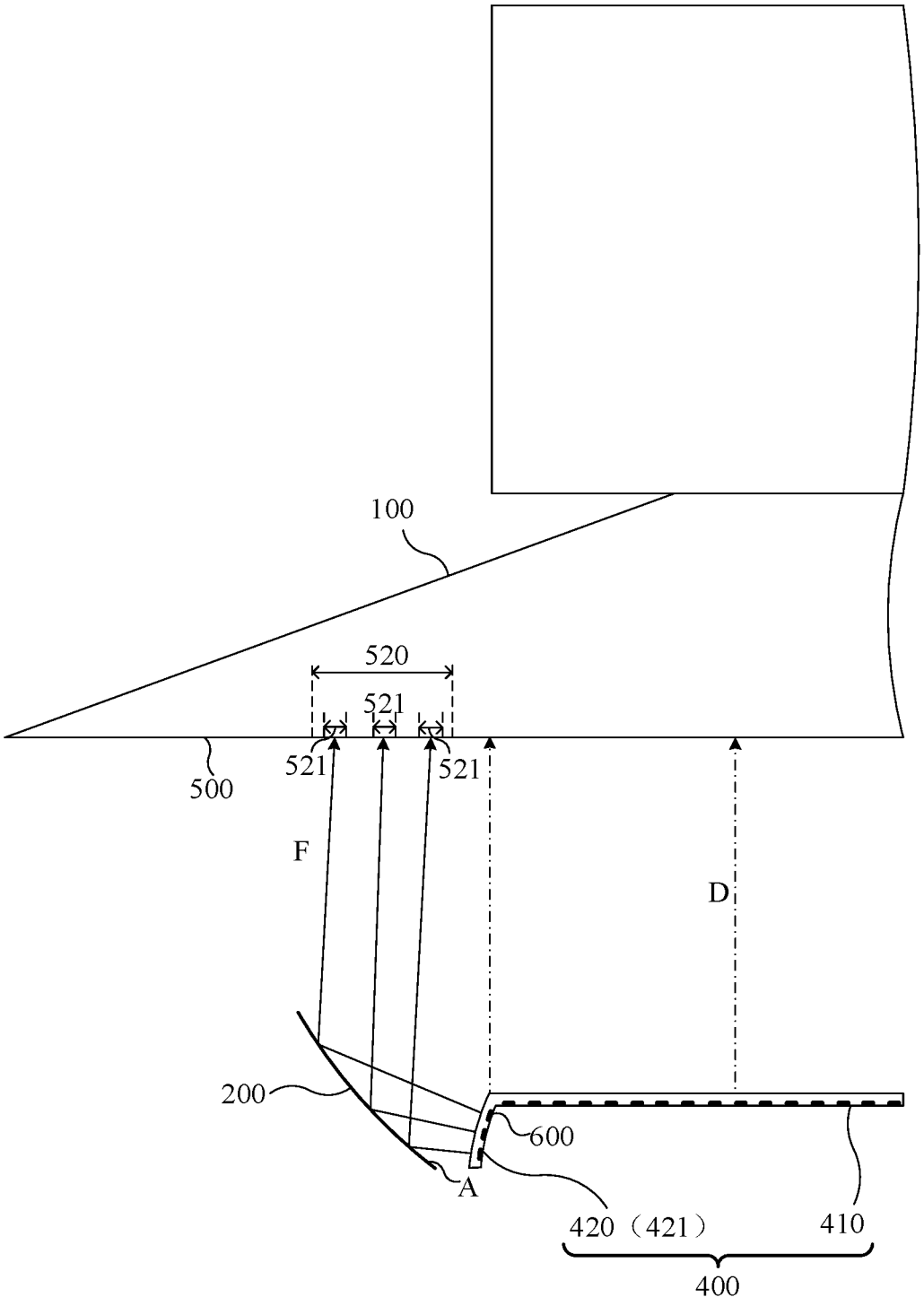
FIG. 8 illustrates a portion of the device in FIG. 4.

FIG. 8 illustrates a portion of the structure in FIG. 4. As shown in FIG. 8, the first curved area 421 may include a plurality of pixels 600, and the second area 520 may include a plurality of pixel areas 521. Each pixel area 521 may correspond to one pixel 600. All principal light F exited from each pixel 600 in the first curved area 421 may be incident on a corresponding pixel area 521, and any two adjacent pixel areas 521 may not overlap.

By properly setting the structure of the light path adjusting component 200, the condition that any two adjacent pixel areas 521 do not overlap may be achieved. Such a setting method may enable the principle light exited from any pixel 600 in the first curved area 521 to be incident on a specific area of the viewfinder plane 500, and the principle light F exited by the adjacent pixels 600 may not interfere with each other. Accordingly, the accuracy of the pixel brightness information obtained by the brightness acquisition component 100 may be further improved.

Further, referring to FIG. 8, the optical path adjustment component 200 may include a reflection mirror (not labeled), and the reflection surface A of the reflection mirror may be disposed opposing to the first curved area 421.

The reflection surface A of the reflection mirror may reflect the principle light F exited from the first curved area 421 to adjust the optical path of the principle light F. By adjusting the optical path of the principle light F, the principle light F with the transmission direction having no intersection point with the viewfinder plane 500 of the brightness acquisition component 100 may be adjusted to be incident on the second area 520 of the viewfinder plane 500 such that the brightness acquisition component 100 may be able to obtain pixel brightness information of the corresponding area of the display panel.

In one embodiment, as shown in FIG. 8, the reflection surface A may be a curved surface, and the curved surface may be convex toward a side facing away from the first curved area 421.

Figure 9:
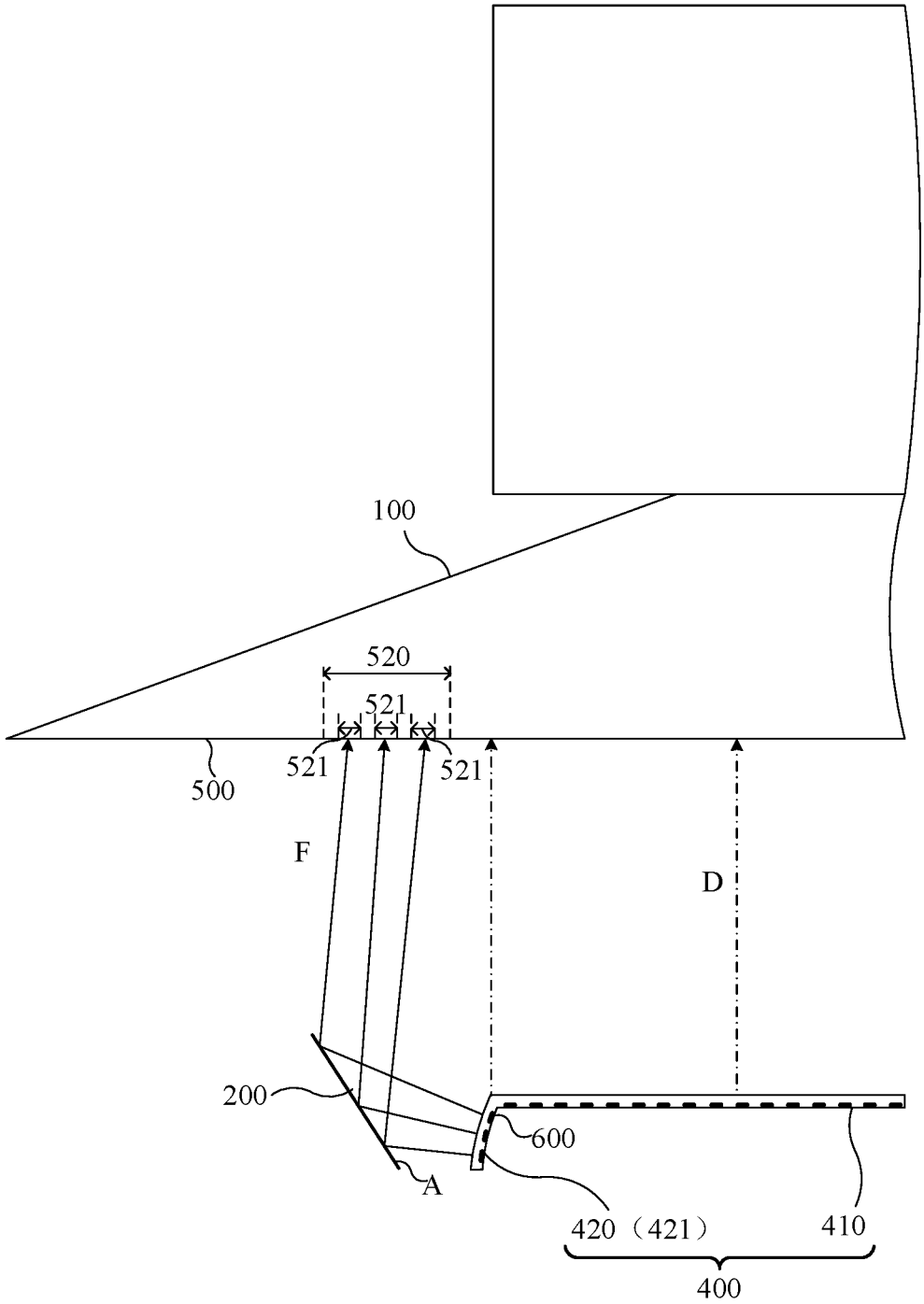
FIG. 9 illustrates a portion of another exemplary device for obtaining brightness of a display panel working normally consistent with various disclosed embodiments of the present disclosure.

In some embodiments as shown in FIG. 9, the reflection surface A of the reflection mirror may also be a flat surface. However, comparing with a flat reflection surface, the curvature of the curved reflection surface A may be adjustable. In one embodiment, an operator may set the curvature of the reflection surface A reasonably according to actual needs. By adjusting the degree of the curvature of the reflection surface A, the distance between the principle light F exited from the adjacent pixels 600 in the first curved area 421 on the viewfinder plane 500 may be increased. Accordingly, the distance between adjacent pixel areas 521 in the viewfinder plane 500 may be increased. Thus, the overlapping of the adjacent pixel areas 521 may be avoided; and the probability that the principle light exited by the adjacent pixels 600 interfere with each other may be reduced.

For the case where the light path adjustment component 200 is a mirror, for the pixels 600 in the curved area 420 of the display panel having the largest distance with the flat area 400, the incident point of the principle light F exited from such pixels on the viewfinder plane 500 may be closest to the first area 500 after the principle light is reflected by the reflection mirror. Thus, in the brightness image captured by the brightness acquisition component 100, the portion of the image corresponding to the curved area 420 may be flipped. In particular, the pixels 600 in the curved area 420 of the display panel 400 closer to the flat area 410 may be far from the flat area 410 in the brightness image. Therefore, when adjusting the degree of curvature of the optical path adjustment component 200, as long as the incident points of the principal light F exited from the pixels 600 farthest from the flat area 410 in the curved area 420 on the viewfinder plane 500 have a certain distance with the first area 510 and the incident points of the principle light F exited by the pixels 600 closest to the flat area 410 in the curved area 420 on the viewfinder plane 500 have a certain distance with the edge corresponding to the view finder surface 500, the degree of the curvature of the optical path adjustment component 200 may be finished.

Figure 10:
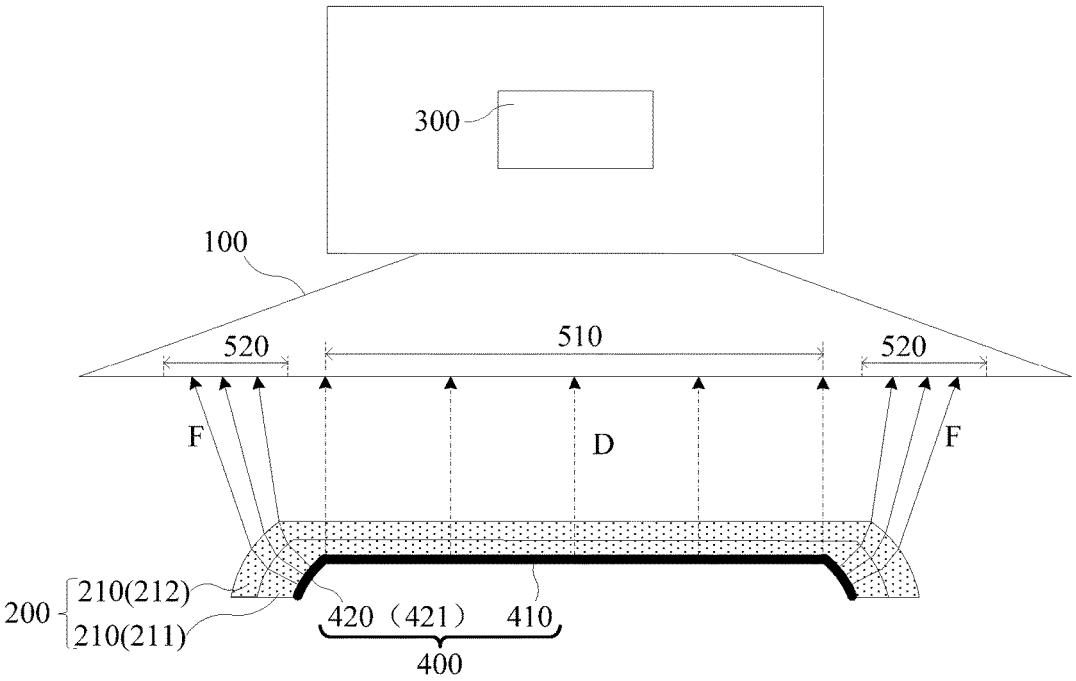
FIG. 10 illustrates another exemplary device for obtaining brightness of a display panel working normally consistent with various disclosed embodiments of the present disclosure.

FIG. 10 illustrates another exemplary device for obtaining brightness of a display panel working normally consistent with various disclosed embodiments of the present disclosure. As shown in FIG. 10, the optical path adjusting component 200 may include at least one refraction layer 210. The refractive index of the refraction layer 210 may be greater than the refractive index of air. When the number of the at least one refraction layer 210 is greater than or equal to 2, the plurality of refraction layers 210 may be sequentially stacked along the light-emitting direction of the display panel; and the refractive indexes may be sequentially reduced.

In one embodiment, as shown in FIG. 10, the optical path adjustment component 200 may include a first refraction layer 211 and a second refraction layer 212 in a solid state. The first refraction layer 211 and the second refraction layer 212 may be sequentially stacked along the light-emitting direction of the display panel 400. The refractive index of the second refraction layer 211 may be smaller than the refractive index of the first refraction layer 211.

When light propagates between two media, the angle between the light and the normal in the optically sparse medium is larger than the angle between the light and the normal in the optically dense medium, and the refractive index of the optically sparse medium is smaller than the refractive index of the optically dense medium. Thus, in one embodiment, the plurality of refraction layers 210 may be sequentially stacked along the light-emitting direction of the display panel 400 and the refractive indexes may be sequentially reduced such that the angle between the principle light F exited from the curved area 420 and after being adjusted by the optical path adjustment component 200 and the normal may be increased, and may be deflected toward the side closer to the brightness acquisition component 100, and may be incident on the viewfinder plane of the brightness acquisition component 100.

The state of the refraction layer 210 may not be specifically limited in the present disclosure. The refraction layer 210 may be liquid, solid, or gas. When the refraction layer 210 is liquid, or gas, to allow the liquid or the gas to be disposed at the corresponding position, the refraction layer may further include a sealing member for sealing the liquid, or the gas.

In one embodiment, referring to FIG. 10, the optical path adjustment component 200 may cover the entire display panel 400. Such a setting method may enable the optical path adjustment component 200 to adjust the optical path of any principle light exited from the display panel 400 to avoid a situation that a portion of the principle light F exited from the first curved area 421 is not adjusted by the optical path adjustment component 200. Thus, it may ensure that all the principle light F exited from the first curved area 421 may be adjusted by the optical path adjustment component 200 and then may be incident on the viewfinder plane 500 of the brightness acquisition component 100.

Further, as shown in FIG. 10, the optical path adjustment component 200 may be attached and fitted to the display panel 400. For such a configuration, on the one hand, the preparation of the refraction layer 210 may be facilitated. On the other hand, a gap may be prevented from forming between the optical path adjustment component 200 and the display panel 400. When the gap is formed between the optical path adjustment component 200 and the display panel 400, the air in the gap may change the optical path of the principle light F exited from the display panel 400, and the difficulty for the optical path adjustment may be increased.

Figure 11:
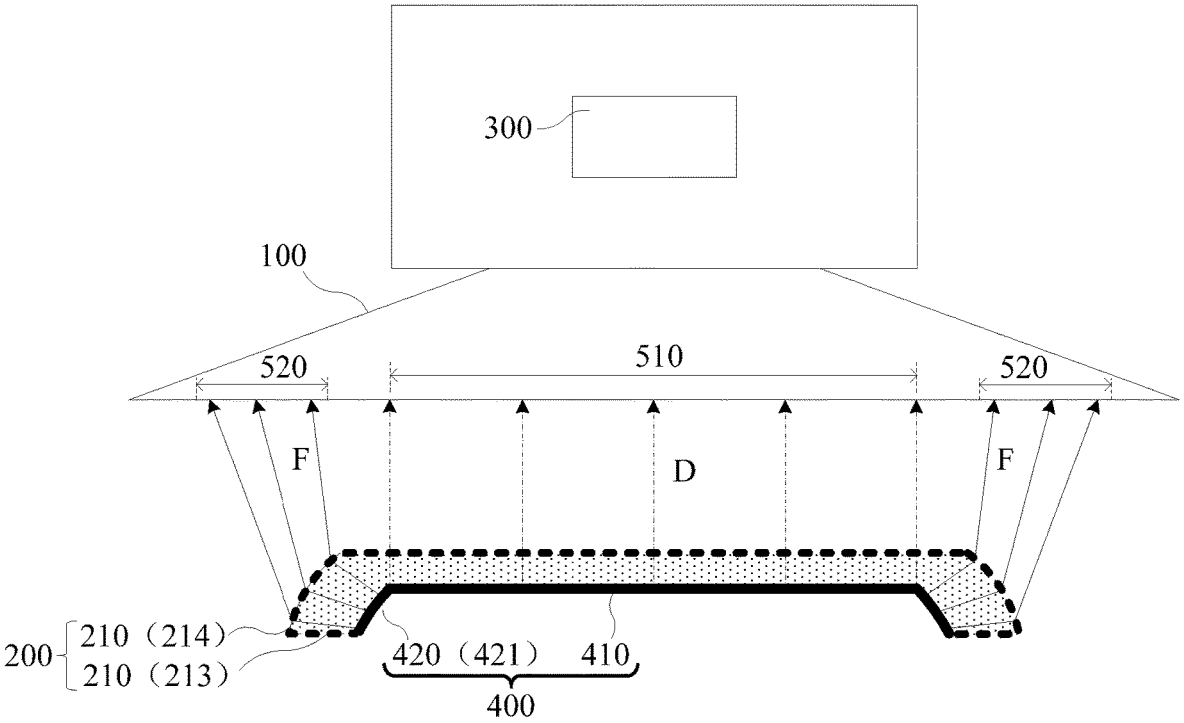
FIG. 11 illustrates another exemplary device for obtaining brightness of a display panel working normally consistent with various disclosed embodiments of the present disclosure.

FIG. 11 illustrates another exemplary device for obtaining brightness of a display panel working normally consistent with various disclosed embodiments of the present disclosure. The structure illustrated in FIG. 11 is similar to the structure illustrated in FIG. 10. The major difference may be that at least one refraction layer 210 in FIG. 11 may include a gas layer 213 and a solid sealing layer 214 sequentially stacked along the light-emitting direction of the display panel 400.

Figure 12:
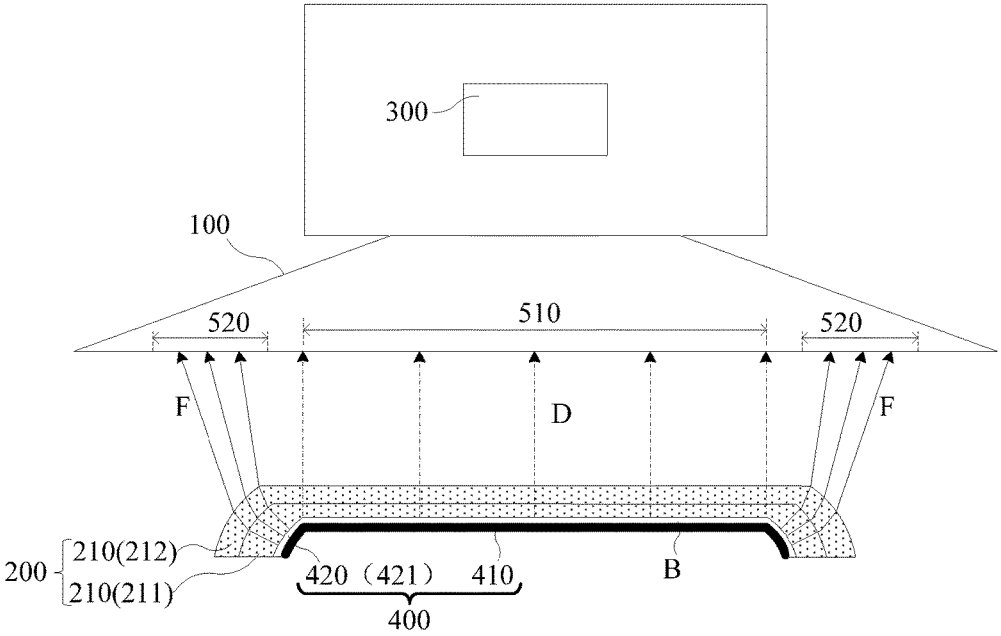
FIG. 12 illustrates another exemplary device for obtaining brightness of a display panel working normally consistent with various disclosed embodiments of the present disclosure.

The structure of the optical path adjustment component 200 illustrated in FIG. 11 may be simple, and may be easy to fabricate, and may be a desirable optical path adjustment component. When there is a bonding error, a gap may be formed between the optical path adjustment component 200 and the display panel 400. The increase of the difficulty of adjusting the optical path may be avoided by changing the environment in the gap. In particular, FIG. 12 illustrates another device for obtaining brightness of a display panel works normally consistent with various disclosed embodiments of the present disclosure. As shown in FIG. 12, a sealed space B may be formed between the optical path adjustment component 200 and the display panel 400. The pressure in the sealed space B may be less than the standard atmospheric pressure. In particular, the sealed space B may be under a vacuum environment. The vacuum environment may not change the transmission path of light. Therefore, after vacuuming the sealed space B, the optical path of the principle light F exited from the display panel 400 in the sealed space B may not change, and the principle light F may be transmitted along a straight line. Thus, the difficulty of the optical path adjustment may be increased.

Figure 13:
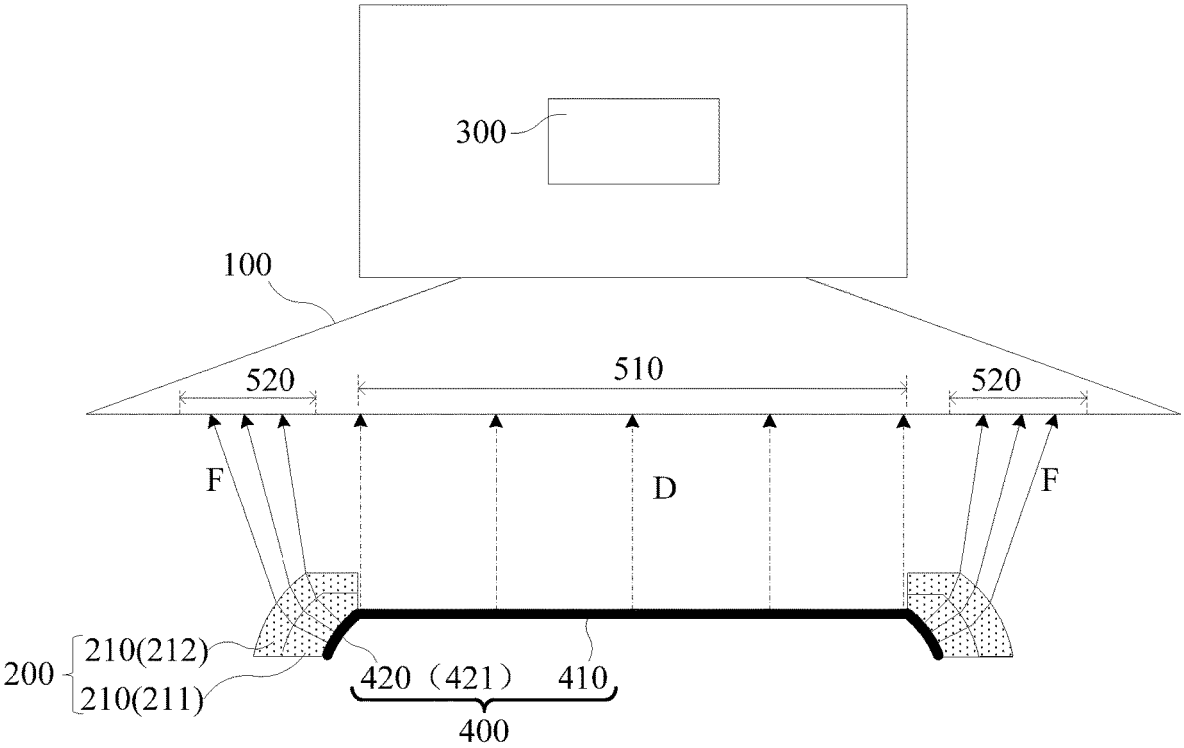
FIG. 13 illustrates another exemplary device for obtaining brightness of a display panel working normally consistent with various disclosed embodiments of the present disclosure.

In some embodiments, the optical path adjustment member 200 may cover only the curved area 420. FIG. 13 illustrates another exemplary brightness obtaining device of a display panel working normally consistent with various disclosed embodiments of the present disclosure. The structure shown in FIG. 13 is similar to the structure shown in FIG. 10. The major difference may be that the optical path adjustment component 200 in FIG. 13 may only cover the curved area 420 to ensure that the principle light F exited from the first curved area 421 may be incident on the viewfinder plane 500 of the brightness acquisition component 100 while the volume of the optical path adjustment component 200 may be reduced.

Figure 14:
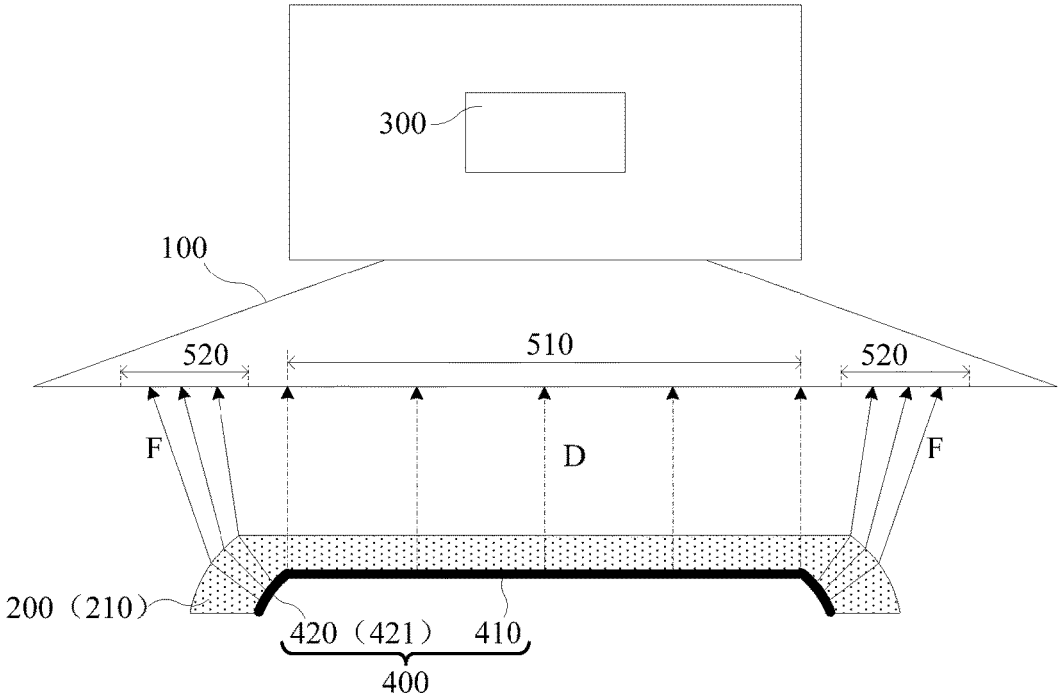
FIG. 14 illustrates another exemplary device for obtaining brightness of a display panel working normally consistent with various disclosed embodiments of the present disclosure.
Figure 15:
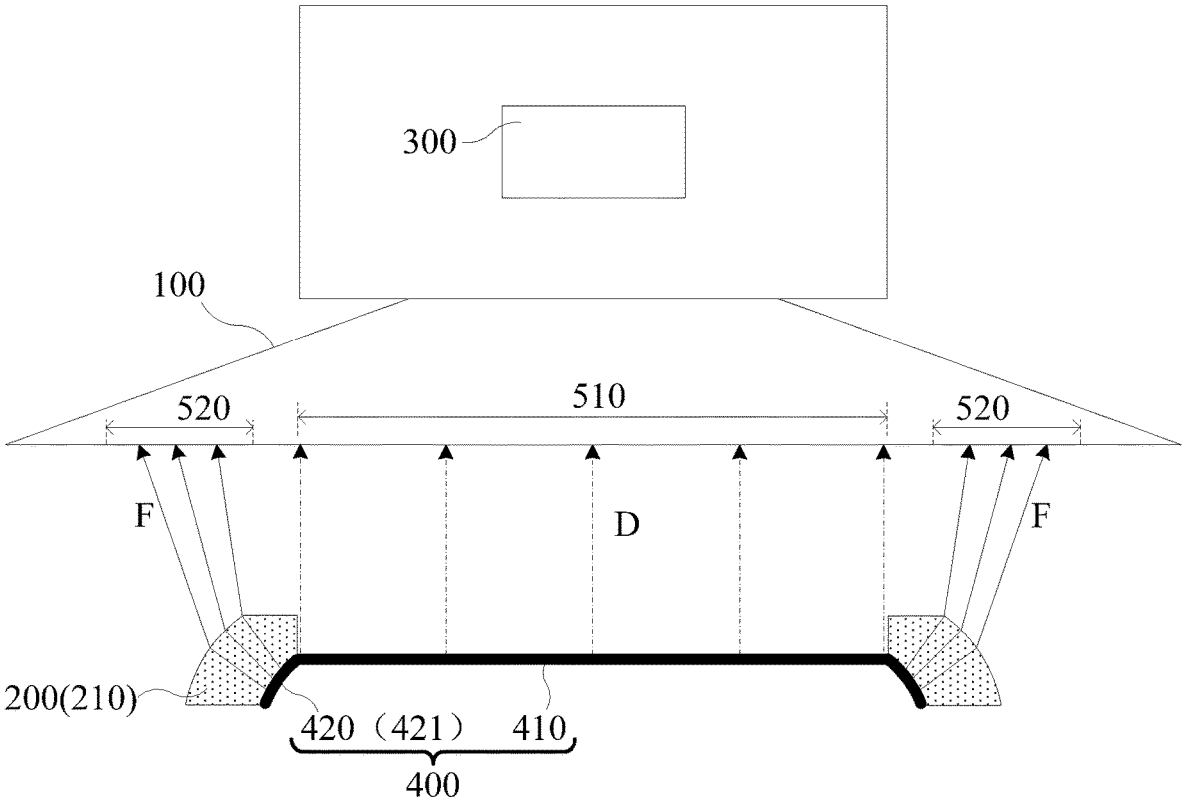
FIG. 15 illustrates another exemplary device for obtaining brightness of a display panel working normally consistent with various disclosed embodiments of the present disclosure.

The number of the refraction layers 210 in the optical path adjustment component 200 may not be specifically limited in the present disclosure. For example, as shown in FIG. 10 and FIG. 13, the optical path adjustment component 200 may include two refraction layers 210, and as shown in FIG. 11, the optical path adjustment component 200 may also include one refraction layer 210. Further, when the optical path adjustment component 200 includes one refraction layer 210, the refraction layer 210 may be a single solid material layer, as shown in FIGS. 14 and 15. The single solid material layer may be easy to prepare, the refractive index of the single solid material layer may be easy to control, and the structure may be simple. Thus, it may facilitate to reduce the difficulty of manufacturing the optical path adjustment component 200, and to improve the optical path adjustment performance.

Figure 16:
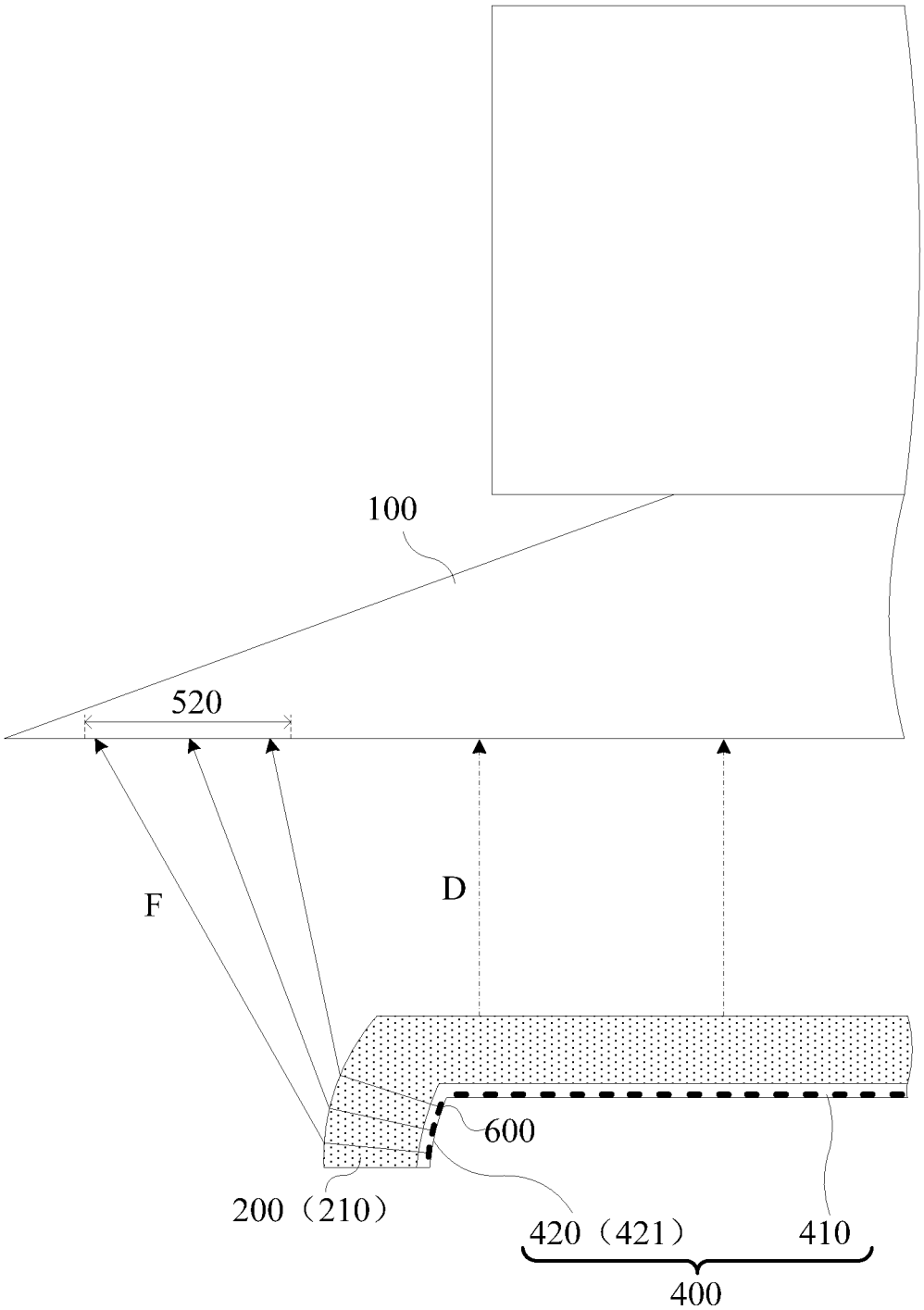
FIG. 16 illustrates a portion of the device in FIG. 15.

FIG. 16 illustrates a portion of the structure in FIG. 15. As shown in FIG. 16, for the case where the optical path adjustment component 200 includes at least one refraction layer 210, for the pixels 600 in the curved area 420 of the display panel 400 farther from the flat area 410, after the principle light F exited by such pixels being refracted on the viewfinder plane 500 of the brightness acquisition component 100, the incident points of the refracted principle light F on the viewfinder plane may be farther from the first region. Thus, in the brightness image captured by the brightness acquisition component 100, the positional relationship between the curved image portion and the flat image portion may be same as the positional relationship between the curved area 420 and the flat area 410 of the display panel 400. The curved image portion may be a portion of the brightness image corresponding to the curved area 420, and the flat image portion may be a portion of the brightness image corresponding to the flat area 410. Therefore, when adjusting the curvature of the optical path adjustment component 200, as long as the incident point of the principal light F exited from the pixel 600 closest to the flat area 410 in the curved area 420 on the viewfinder plane 500 has a certain distance with the first area, and the incident point of the principle light F exited by the pixel 600 farthest from the flat area 410 in the curved area 420 on the viewfinder plane 500 has a certain distance with the edge corresponding to the viewfinder plane 500, the adjustment may be finished.

Figure 17:
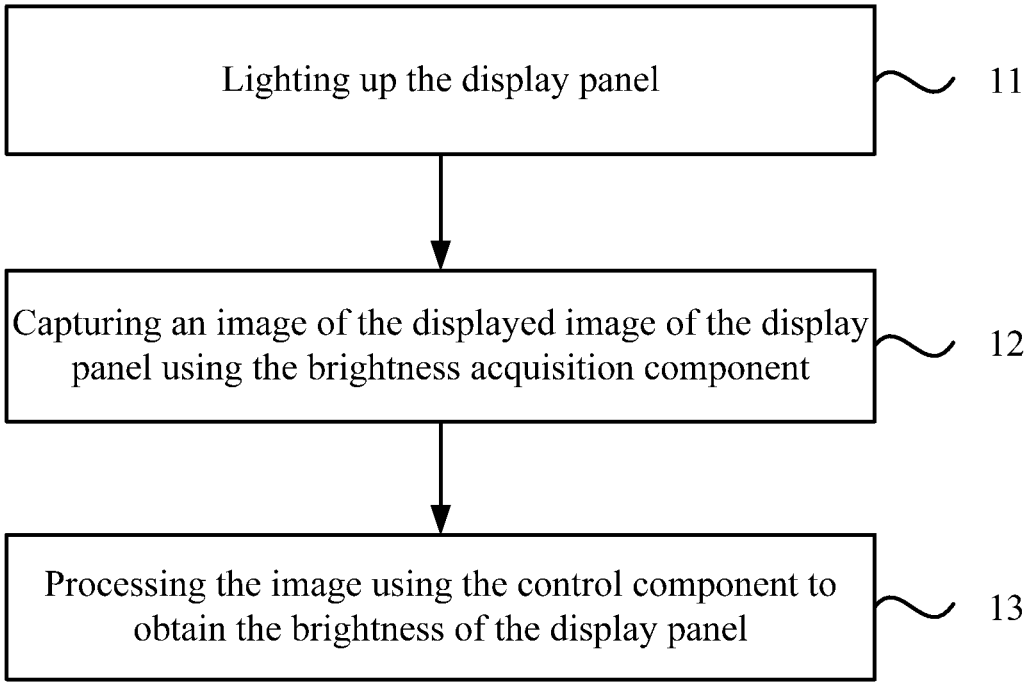
FIG. 17 illustrates a flowchart of an exemplary method for obtaining brightness of a display panel consistent with various disclosed embodiments of the present disclosure.

The present disclosure also provides a method for obtaining brightness of a display panel. FIG. 17 illustrates a flowchart of an exemplary method of for obtaining brightness of a display panel consistent with various disclosed embodiments of the present disclosure. The method for obtaining brightness of the display panel may be implemented using the device for obtaining the brightness of the display panel provided by the present disclosure, or other appropriate device.

As shown in FIG. 17, the method for obtaining brightness of the display panel may include Step 11: lighting up the display panel.

In one embodiment, the display panel may be a flexible display panel. For example, the display panel may include a flat area and a curved area, and the curved area may be located on two opposite sides of the flat area. In particular, the display panel may include a plurality of pixels, and each pixel may be lit to light up the display panel such that each pixel may emit light. Optionally, the display panel may be an organic light-emitting display panel, and correspondingly, the pixels may be organic light-emitting devices. Each organic light-emitting device may include a first electrode, an organic light-emitting functional layer, and a second electrode that are sequentially stacked along a light-emitting direction of the light-emitting device. Each organic light-emitting device may be electrically connected to a pixel driving circuit, and the pixel driving circuit may be configured to drive the corresponding organic light-emitting device to emit light.

The method for obtaining brightness of the display panel may also include Step 12: using a brightness acquisition component to take an image of the displayed imaged of the display panel.

The "image" is a brightness image of the display panel, and it may contain pixel brightness information of the display panel. The optical path adjustment component in the brightness acquisition component of the display panel may enable the principle light exited from each area of the display panel to be incident on the viewfinder plane of the brightness acquisition component such that the brightness acquisition component may be able to form the image containing the brightness information of the pixels in the entire display panel.

Further, the method for obtaining brightness of the display panel may include Step 13: using a control component to process the image to obtain the brightness of the display panel.

The "brightness of the display panel" is the brightness of each pixel after a brightness compensation process. In particular, the control component may extract the brightness of each pixel from the image captured by the brightness acquisition component, and may obtain the brightness of the display panel based on the brightness of the pixel and a preset method.

In the technical solution provided in the present disclosure, by lighting up the display panel, the brightness acquisition component may be configured to capture an image of the displayed image, and the control component may be used to process the image to obtain the brightness of the display panel. Accordingly, the pixel brightness compensation of the display panel may be realized, and the display effect of the display panel may be effectively improved.

In one embodiment, the step for using the control component to process the image to obtain the brightness of the display panel may include obtaining a brightness compensation coefficient of each pixel in the curved area; extracting the first original brightness of each pixel in the curved area in the image; obtaining the target brightness of each pixel in the curved area according to the brightness compensation coefficient and the first original brightness; extracting the second original brightness of each pixel in the flat area in the image; and configuring the second original brightness of each pixel in the flat area and the target brightness of each pixel in the curved area as the brightness of the display panel.

Figure 18:
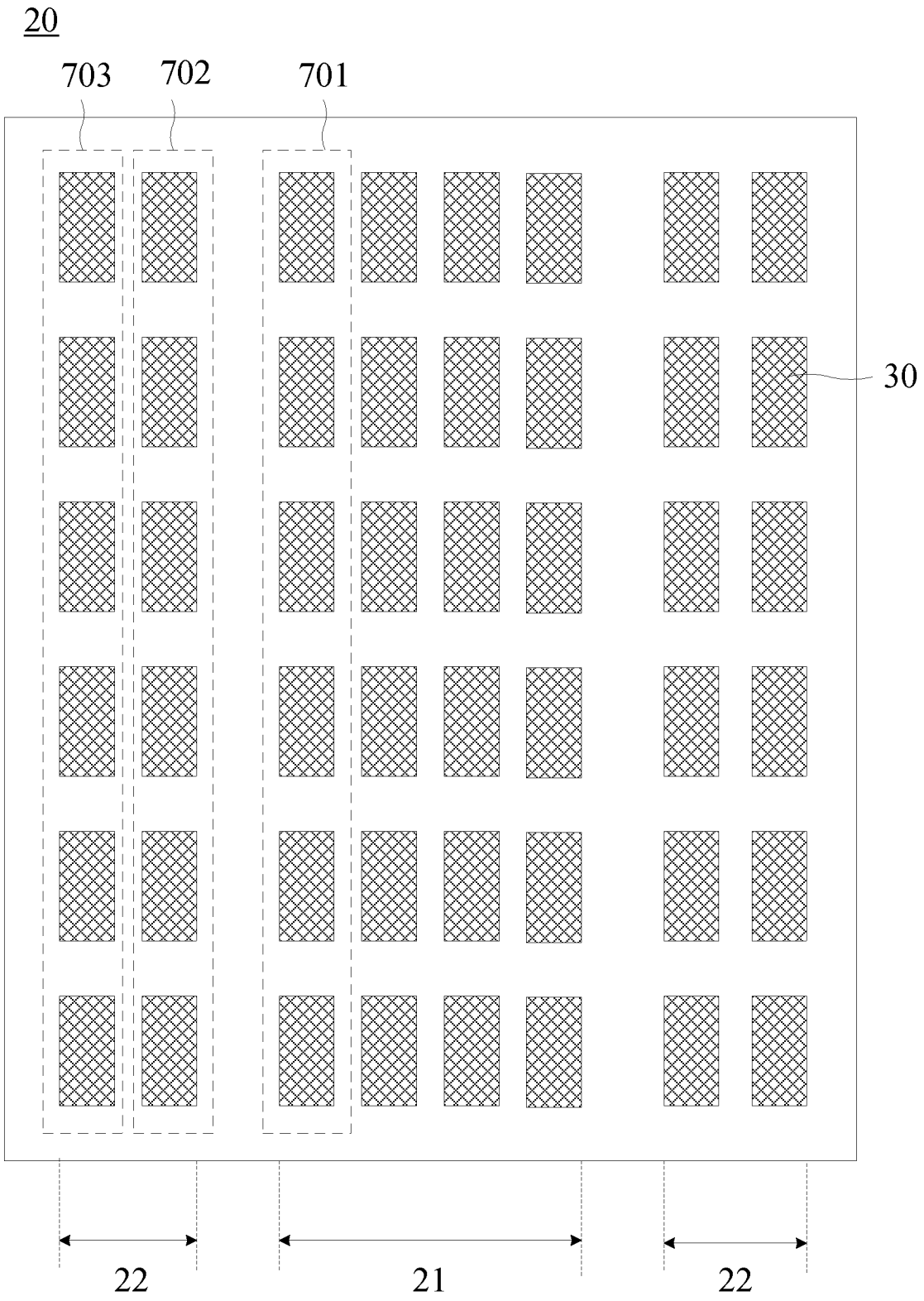
FIG. 18 illustrates an exemplary brightness image of a display panel consistent with various disclosed embodiments of the present disclosure.

FIG. 18 illustrates an exemplary brightness image of a display panel consistent with various disclosed embodiments of the present disclosure. As shown in FIG. 18, the brightness image 20 captured by the brightness acquisition component may include a flat region 21 and a curved region 22, and each of the flat region 21 and the curved region 22 may include a plurality of pixels 30. Based on this structure, the step for obtaining the brightness of the display panel may include obtaining the brightness compensation coefficient of each of the twenty four pixels 30 in the curved region 22, and the specific obtaining method will be described later in detail. Then, the brightness of each of the twenty four pixels 30 in the curved surface area 22 in the brightness image 20 may be extracted as the first original brightness of the corresponding pixel 30. So far, the brightness compensation coefficient and the first original brightness of each pixel 30 in the curved surface area 22 may be known parameters. Based on the two known parameters and a preset calculation method, the brightness of the corresponding pixel 30 after the compensation may be obtained. In particular, the target brightness of each pixel 30 may be obtained.

The brightness of the display panel may be the brightness information of all pixels in the display panel, including the pixel brightness information in the flat area and the pixel brightness information in the curved area. In particular, the brightness of the display panel may the pixel brightness information in the flat area 21 and the pixel brightness information in the curved area 22 in FIG. 18. The pixel brightness information in the curved area 22 may be the target brightness of the obtained pixels 30. The principle light exited by the pixels 30 in the flat area 22 may be directly incident on the viewfinder plane of the brightness acquisition component, and no brightness compensation may be required. Therefore, the brightness of each pixel 30 in the flat area 21 in the brightness image 20 may be extracted as the second original brightness of the corresponding pixels 30 and the pixel brightness information in the flat area 21.

Further, the step for obtaining the brightness compensation coefficient of each pixel in the curved area may include extracting the second original brightness of the n-columns of pixels in the flat area near one side of the curved area; calculating the first average value of the second original brightness of the n-columns of pixels; extracting the first original brightness of each pixel in the curved area, and calculating the second average value of the first original brightness of each adjacent m-columns of pixels; taking the ratio of each second average value to the first average value as the brightness compensation coefficient of each pixel corresponding to the second average value. n and m may be both positive integers; and $1 \leq n \leq P$ is the total number of columns of pixels in the flat area. $1 \leq m \leq Q$, and Q is an integer time of m, and Q is the total number of columns of the pixels in the curved area.

Taking the brightness image 20 shown in FIG. 18 as an example, and setting n=1, in particular, the brightness of six pixels 30 in the first pixel column 701 in the flat area 21 near the curved area 22 and on the left side of the curved area 22 may be extracted as the second original brightness V1, V2, V3, V4, V5, and V6 of the six pixels 30. The first average value of the first original brightness of the six pixels 30 in the first pixel column 701 may be calculated as P=(V1+V2+V3+V4+V5+V6)/6. The brightness of each of the twelve pixels 30 in the curved area 22 may be extracted as the first original brightness U1, U2, U3, U4, U5, U6, U7, U8, U9, U10, U11, and U12 of the corresponding pixels 30. U1 U2, U3, U4, U5, and U6 may be the first original brightness of the six pixels 30 in the second pixel column 702, and U7, U8, U9, U10, U11, and U12 may be the first original brightness of the six pixels 30 in the third pixel column 703, respectively. By setting m=1, the second average value of the first original brightness of the six pixels 30 in the second pixel column 702 may be calculated as Q1=(U1+U2+U3+U4+U5+U6)/6, and the second average value of the first original brightness of the six pixels 30 in the third pixel column 703 may be calculated as Q2=(U7+U8+U9+U10+U11+U12)/6. The ratio T1=Q1/P may be used as the brightness compensation coefficient of each pixel 30 in the second pixel column 702, and the ratio T2=Q2/P may be used as the brightness compensation coefficient of each pixel 30 in the third pixel column 703.

The curved surface area 22 may be two or more. For illustrative purposes, FIG. 18 only include two curved surface areas 22 located on opposing sides of the flat area 21 respectively. The brightness compensation coefficients of the pixels 30 in each curved area 22 may be obtained according to the pixel brightness information of the n-pixel columns in the flat region 21 near the curved surface region 22 and the pixel brightness information in the pixels in the n-pixel columns. For example, as described above, the brightness compensation coefficients of the pixels 30 in the left curved area 22 in FIG. 18 may be obtained according to the pixel brightness information of the first pixel column 701 in the planar area 21 near the curved area 22 and the pixel brightness information of each the pixel 30 in the left curved area 22.

In one embodiment, the step for obtaining the target brightness of each pixel in the curved area according to the brightness compensation coefficient and the first original brightness may include: multiplying the first original brightness of each pixel in the curved area and the brightness compensation coefficient and configuring the product as the target brightness of the pixel.

Further, for illustrative purposes, as shown in FIG. 18, U1, U2, U3, U4, U5, and U6 may be the first original brightness of the six pixels 30 in the second pixel column 702, respectively, and T1=Q1/P may be the brightness compensation coefficient of each pixel 30 in the second pixel column 702; and U1×T1, U2×T1, U3×T1, U4×T1, U5×T1, and U6×T1 may be configured as the target brightness of each pixel 30 in the second pixel column 702. U6, U7, U8, U9, U10, U11, and U12 may be the first original brightness of the six pixels 30 in the third pixel column 703, respectively; and T2=Q2/P may be the brightness compensation coefficient of each pixel 30 in the third pixel column 703; and U7×T2, U8×T2, U9×T2, U10×T2, U11×T2, and U12×T2 may be configured as the target brightness of each pixel 30 in the third pixel column 703.

For illustrative purposes, FIG. 18 only uses n=1 and m=1 as an example for description. However, the values of m and n are not limited by the present disclosure. In some embodiments, n and m may also be values other than 1, for example, the range of n may be $5 \leq n \leq 15$, and m=1.

The edge of the flat area is the transition area between the flat area and the curved area. The pixel brightness information in such a transition area may be affected by the curved area; and there may be certain differences for the pixel brightness information of other areas in the flat area. The compensation effect corresponding to the obtained brightness compensation coefficient of the pixel may be not as desired. Thus, the value of n may not be too small. Further, if the value of n is too large, the amount of calculation may be increased. Accordingly, the calculation difficulty of the pixel brightness compensation coefficients may be increased. When $5 \leq n \leq 15$, the brightness compensation effect of the pixel may be as desired, and the calculation difficulty may be moderate.

Further, according to the above-mentioned calculation method of the brightness compensation coefficients of the pixels, the smaller m is, the more accurate the brightness compensation coefficient of the pixel is, the higher the correlation with the corresponding pixel is, and the better the compensation effect is. Thus, m=1 may be a desirable value.

According to the technical solutions provided by the present disclosure, an optical path adjustment component may be disposed on an optical path of light exited from a first curved area of a display panel, and the optical path adjustment component may be configured to adjust principle light exited from the first curved area to be incident on a second area of the viewfinder plane of the brightness acquisition component. The second area may not overlap the first area of the viewfinder plane of the brightness acquisition component corresponding to the principle light exited from the flat area of the display panel such that the principle light exited from the flat area and the first curved area in the display panel may be incident on different areas of the viewfinder plane of the brightness acquisition component. The brightness acquisition component may obtain the brightness information of all pixels in the display panel, and the principle light exited from the flat area and the first curved area may not interfere with each other. Accordingly, the accuracy of the pixel brightness information obtained by the brightness acquisition component may be improved, and the compensation effect may be effectively enhanced.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A device for obtaining brightness of a display panel, the display panel including a flat area and a curved area and the curved area including at least one first curved area, the device comprising: a brightness acquisition component; an optical path adjustment component; and a control component, wherein: the brightness acquisition component is configured to face straight to the flat area of the display panel; principle light exited from the flat area is incident on a first area of a viewfinder plane of the brightness acquisition component; the optical path adjustment component is disposed on an optical path of principle light exited from the first curved area, and configured to adjust the principle light exited from the first curved area to be incident on a second area of the viewfinder plane of the brightness acquisition component; the first area does not overlap with the second area; and the control component is connected to the brightness acquisition component and configured to process an image captured by the brightness acquisition component to obtain the brightness of the display panel.

2. The device according to claim 1, wherein:
the first curved area includes a plurality of pixels;
the second area includes a plurality of pixel areas;
each pixel area of the plurality of pixel areas corresponds to one pixel of the plurality of pixels;
all principle light exited from any pixel of the plurality of pixels in the first curved area are incident on a corresponding pixel area; and
any two adjacent pixel areas do not overlap with each other.

3. The device according to claim 1, wherein:
the curved area further includes a second curved area;
the second curved area is located between the first curved area and the flat area; and
principle light exited from the second curved area is directly incident on the first area of the viewfinder plane of the brightness acquisition component.

4. The device according to claim 1, wherein:
the optical path adjustment component includes a reflection mirror; and
a reflection surface of the reflection mirror is disposed opposing to the first curved surface.

5. The device according to claim 4, wherein:
the reflection surface is a curved surface; and
the curved surface is convex toward a side facing away from the first curved area.

6. The device according to claim 1, wherein:
the optical path adjustment component includes at least one refraction layer;
a refractive index of the at least one refraction layer is greater than a refractive index of air; and
when the at least one refraction layer includes a plurality of refraction layers, the plurality of refraction layers are sequentially stacked along a light-emitting direction of the display panel and refractive indexes of the plurality of refection layers are sequentially decreased along the light-emitting direction of the display panel.

7. The device according to claim 6, wherein:
the optical path adjustment component only covers the curved area.

8. The device according to claim 6, wherein:
the optical path adjustment component covers the display panel.

9. The device according to claim 8, wherein:
the optical path adjustment component is attached and fitted to the display panel.

10. The device according to claim 9, wherein:
at least one of the plurality of refraction layers includes a gas layer and a solid sealed layer sequentially stacked along the light-emitting direction of the display panel.

11. The device according to claim 8, wherein:
a sealed space is located between the optical path adjustment component and the display panel; and
a pressure of the sealed space is smaller than an atmosphere pressure.

12. The device according to claim 8, wherein:
the at least one of the plurality of refraction layers includes a single solid material layer.

13. A method for obtaining brightness of a display panel, comprising: providing a display panel including a flat area, and a curved area including at least a first curved area; providing a device for obtaining brightness of the display panel, wherein: the device includes a brightness acquisition component, an optical path adjustment component, and a control component; the brightness acquisition component is configured to face straight to the flat area of the display panel; principle light exited from the flat area is incident on a first area of a viewfinder plane of the brightness acquisition component; the optical path adjustment component is disposed on an optical path of principle light exited from the first curved area, and configured to adjust the principle light exited from the first curved area to be incident on a second area of the viewfinder plane of the brightness acquisition component; the first area does not overlap with the second area; and the control component is connected to the brightness acquisition component and configured to process an image captured by the brightness acquisition component to obtain the brightness of the display panel; lighting up the display panel; capturing an image of a displayed image of the display panel using the brightness acquisition component; and processing the image using the control component to obtain the brightness of the display panel.

14. The method according to claim 13, wherein:
the first curved area includes a plurality of pixels;
the second area includes a plurality of pixel areas;
each pixel area of the plurality of pixel areas corresponds to one pixel of the plurality of pixels;
all principle light exited from each pixel of the plurality of pixels in the first curved area are incident on a corresponding area; and
any two adjacent pixel areas do not overlap with each other.

15. The method according to claim 14, wherein processing the image using the control component to obtain the brightness of the display panel comprises:
obtaining a brightness compensation coefficient of each pixel of the plurality of pixels in the curved area;
extracting a first original brightness of each pixel of the plurality of pixels in the curved area in the image;
obtaining a target brightness of each pixel of the plurality of pixels in the curved area according to the brightness compensation coefficient and the first original brightness;
extracting a second original brightness of each pixel of the plurality of pixels in the flat area in the image; and configuring the second original brightness of each pixel of the plurality of pixels in the flat area and the target brightness of each pixel of the plurality of pixels in the curved area as the brightness of the display panel.

16. The method according to claim 14, wherein obtaining the brightness compensation coefficient of each pixel of the plurality of pixels in the curved surface comprises:

extracting the second original brightness of n-columns of pixels in the flat area near one side of the curved area and calculating a first average value of the second original brightness of the n columns of pixels;

extracting the first original brightness of each pixel in the curved area, and calculating a second average value of the first original brightness of every adjacent m-columns of pixels;

configuring a ratio of each second average value to the first average value as the brightness compensation coefficient of each pixel corresponding to the second average value;

n and m are both positive integers;

$$1 \leq n \leq P;$$

P is a total number of columns of pixels in the flat area;

$$1 \leq m \leq Q;$$

Q is an integer time of m; and

Q is a total number of columns of the pixels in the curved area.

17. The method according to claim 16, wherein:

$$5 \leq n \leq 15.$$

18. The method according to claim 16, wherein:

$$m=1.$$

19. The method according to claim 14, wherein obtaining the target brightness of each pixel of the plurality of pixels in the curve area according to the brightness compensation coefficient and the first original brightness comprises:

configuring a product of the first original brightness and the brightness compensation coefficient of a pixel of the plurality of pixels in the curved area as the target brightness of the pixel.

* * * * *